United States Patent [19]

Sakai

[11] 4,050,679

[45] Sept. 27, 1977

[54] METHOD AND APPARATUS FOR CONTROLLING THE FURNACE TOP GAS PRESSURE OF BLAST FURNACES

[76] Inventor: Kiyotoshi Sakai, 12-3-503, Tenjin 1-chome, Tobata, Kita-Kyushu, Fukuoka, Japan

[21] Appl. No.: 736,108

[22] Filed: Oct. 27, 1976

[30] Foreign Application Priority Data

Nov. 9, 1975 Japan ..... 50-134829

[51] Int. Cl.[2] ..... C21B 7/00

[52] U.S. Cl. ..... 266/44; 214/35 R; 266/89; 266/183

[58] Field of Search ..... 214/35 R, 18 V; 266/44, 266/89, 183, 199

[56] References Cited

U.S. PATENT DOCUMENTS 3,966,062 6/1976 Sakai ..... 266/183 X

FOREIGN PATENT DOCUMENTS 411,300 6/1966 Japan ..... 266/89

*Primary Examiner*—Roy Lake

*Assistant Examiner*—Paul A. Bell

*Attorney, Agent, or Firm*—Charles E. Pfund

[57] ABSTRACT

In a blast furnace installation comprising a blast furnace and a raw material charging apparatus including a hollow inverted frustum shaped rotary hopper mounted above the blast furnace, conveyor means for supplying the raw material to the rotary hopper, a hollow disc shaped impeller located beneath the rotary hopper for receiving the raw material therefrom, stationary inclined chute means including an annular chamber member surrounding the periphery of the impeller for receiving the raw material discharged from the impeller, and an electric motor for driving the impeller, the gas pressure in the furnace top is accurately controlled by detecting the gas pressure in the annular chamber member at a plurality of circumferentially spaced points, comparing the mean value of the detected gas pressure with a preset furnace top gas pressure for producing a control signal proportional to the difference therebetween, and controlling the speed of the motor by the control signal thereby reducing substantially to zero the amount of the gas discharged to the atmosphere from the impeller.

5 Claims, 5 Drawing Figures

METHOD AND APPARATUS FOR CONTROLLING THE FURNACE TOP GAS PRESSURE OF BLAST FURNACES

BACKGROUND OF THE INVENTION

This invention relates to a novel method and apparatus for controlling the furnace top gas pressure of a blast furnace, and more particularly to a method and apparatus for controlling the furnace top gas pressure of a blast furnace capable of continuously charging raw material into the blast furnace while maintaining the top gas pressure at a predetermined value.

In order to operate a blast furnace stably under a high pressure, it is essential to accurately control the furnace top gas pressure to be always constant. When the top gas pressure of a blast furnace varies, the flow speed of gas through the furnace varies so that the reaction condition in the furnace varies thus causing an unstable furnace operation. Moreover, a rapid gas flow is created in a gap wich communicates the interior of the blast furnace with the outside atmosphere thus accelerating the wear of the associated component part of the charging apparatus as well as burning thereof.

According to a conventional method of controlling the furnace top gas pressure, a regulating valve which throttles the flow quantity of the gas is provided for an exhaust gas conduit. On the other hand, the method and apparatus for preventing the leakage of gas through raw material charging apparatus should be different depending upon the construction of the raw material charging apparatus, so that there is no effective method of preventing the leakage of gas which can be used for any type of the charging apparatus.

SUMMARY OF THE INVENTION

The invention contemplates the provision of a method and apparatus for controlling a furnace top gas pressure especially suitable to be used in a blast furnace equipped with a raw material charging apparatus disclosed in my U.S. Pat. No. 3,966,062 issued on June 29, 1976.

Accordingly, it is an object of this invention to provide an improved method and apparatus for controlling the furnace top gas pressure of a blast furnace wherein the quantity of the gas leaking to the atmosphere from the negative pressure region of an impeller utilized to charge the raw material is reduced to zero in response to the furnace top gas pressure which varies in a certain range, thus causing the furnace gas to be discharged only through an exhaust conduit thereby accurately controlling the furnace top gas pressure and preventing damage to the raw material charging apparatus.

The raw material charging apparatus disclosed in the patent is different from a bell type raw material throwing apparatus and constructed such that the raw material is loaded by utilizing centrifugal force and that a negative pressure region is formed at the portion of the charging apparatus which is communicated with the surrounding atmosphere for minimizing the leakage of the furnace gas, thereby permitting continuous charging of the raw material without causing maldistribution thereof. The raw material charging apparatus according to the U.S. patent comprises a hollow inverted frustum shaped rotary hopper mounted above the furnace top, a disc shaped hollow impeller located below the rotary hopper, a stationary inclined chute opposing the periphery of the impeller, and an electric motor mounted above the rotary hopper for driving the impeller. With this construction, however, it is impossible to directly measure the quantity of the gas leaking to the atmosphere from the negative pressure region formed by the impeller rotating at a high speed so that it has been obliged to determine, through gas analysis, the variations in the amounts of CO, $CO_2$ or other gases in the atmosphere for supervizing the leakage of the gas. For this reason, in order to determine an ideal number of revolutions of the impeller (the critical number of revolution that can scarcely reduce to zero the quantity of the gas leaked through the negative pressure region) commensurate with various furnace top gas pressures, it has been necessary to perform various preliminary tests and to select, in accordance with the result of the preliminary test, a suitable number of revolutions of the impeller for a particular furnace top gas pressure. Moreover, when the furnace top gas pressure varies about a set pressure, it is difficult to vary the number of revolutions of the impeller to follow up such variation in the furnace top gas pressure with the result that above described ideal number of revolutions can never be realized.

For this reason, in accordance with this invention, in response to the variation in the furnace top gas pressure the number of revolutions of the impeller is controlled correspondingly to increase the ability of interrupting the gas leakage through the negative pressure region. I have found that, due to the construction of a stationary annular chamber member disposed to surround the discharge port of the impeller, there is formed in the chamber a stagnant layer of dense gas having substantially the same pressure as the furnace top gas pressure (controlled a predetermined value) and according to this invention, when a difference is created between the pressure at the annular chamber member and the predetermined furnace top gas pressure, this difference is used to vary the speed of the impeller for maintaining the gas leakage interruption ability. More particularly, an ideal speed of the impeller commensurate with the variation in the furnace top gas pressure can be obtained when the difference between the predetermined furnace top gas pressure and the mean pressure at the periphery of the discharge port of the impeller or inside the annular chamber member is substantially zero.

According to one aspect of this invention, there is provided a method of controlling the gas pressure in the top of a blast furnace equipped with a raw material charging apparatus including a hollow inverted frustum shaped rotary hopper mounted above the blast furnace, conveyor means for supplying the raw material to the rotary hopper, a hollow disc shaped impeller located beneath the rotary hopper for receiving the raw material therefrom, stationary inclined chute means including an annular chamber member surrounding the periphery of the impeller for receiving the raw material discharged therefrom, and an electric motor mounted above the rotary hopper for driving the impeller, the method comprising the steps of detecting the gas pressure in the annular chamber member of the inclined chute means at a plurality of circumpherentially spaced points, comparing the mean value of the detected gas pressure with a preset furnace top gas pressure for producing a control signal proportional to the difference therebetween, and controlling the speed of the motor by the control signal thereby reducing substantially to zero the amount of the gas discharged to the atmosphere from the impeller.

According to another aspect of this invention there is provided apparatus for controlling the gas pressure in the top of a blast furnace which is equipped with a raw material charging apparatus including a hollow inverted frustum shaped rotary hopper mounted above the blast furnace, conveyor means for supplying the raw material to the rotary hopper, a hollow disc shaped impeller located beneath the rotary hopper for receiving the raw material therefrom, stationary inclined chute means including an annular chamber member surrounding the periphery of the impeller for receiving the raw material discharged therefrom, and an electric motor mounted above the rotary hopper for driving the impeller, the apparatus comprising a main control system detecting the furnace top gas pressure to control, in accordance with a predetermined furnace top gas pressure, the amount of gas discharged through a gas exhaust conduit, a plurality of pressure detectors provided for the annular chamber member at equally spaced points around the periphery of the annular chamber member, a plurality of electric signal generators responsive to the outputs of the pressure detectors respectively, a computer for producing the mean value of the electric signals produced by the electric signal generators, a regulator for producing an output proportional to the difference between the mean value and an electric signal corresponding to the predetermined furnace top gas pressure, and servo-means responsive to the output from the regulator for controlling the speed of the motor thereby reducing substantially to zero the amount of the gas discharged to the atmosphere from the impeller.

In addition to the control apparatus described above there is provided an additional control system comprising a pressure differential transmitter for generating an electric signal to be supplied to the regulator in response to the difference between the pressure in the blast furnace and the pressure in the annular chamber member of the inclined chute means.

BRIEF DESCRIPTION OF THE DRAWINGS

Further objects and advantages of this invention can be more fully understood from the following detailed description taken in conjunction with the accompanying drawings in which.

DESCRIPTION OF THE PREFERRED EMBODIMENT

Figure 3:
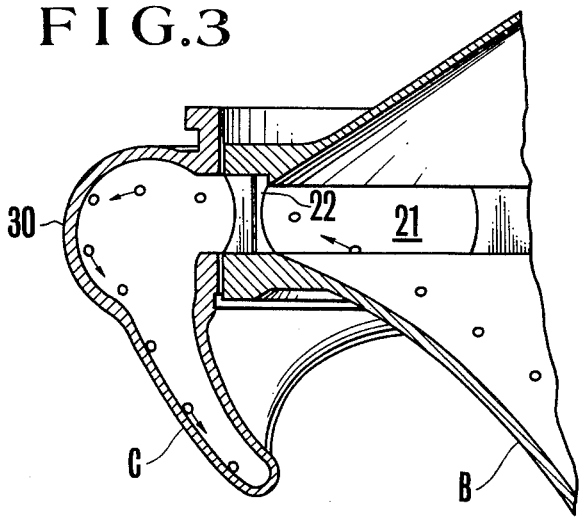
FIG. 3 is an enlarged partial sectional view showing the relative arrangement between the impeller and the inclined chute utilized in the blast furnace shown in FIG. 1.
Figure 4:
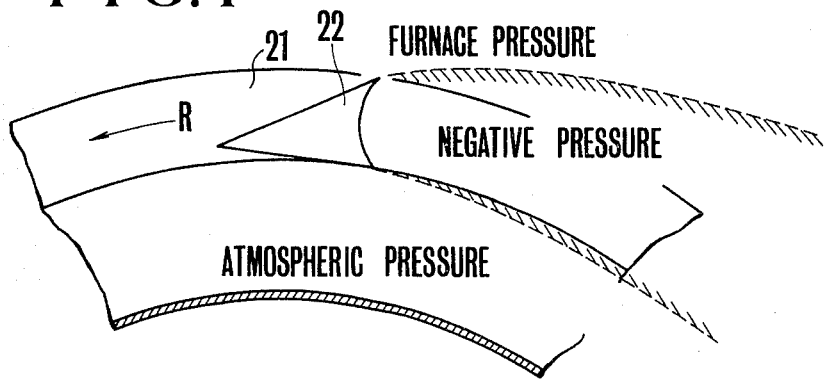
FIG. 4 is a diagram utilized to explain the manner of forming a negative pressure region due to the high speed rotation of the impeller.

Before describing the invention, a blast furnace provided with a raw material charging apparatus as disclosed in the aforementioned patent will firstly be described with reference to FIG. 1. As shown therein, above a blast furnace 1 is installed a raw material charging apparatus which includes a rotary hopper A in the form of an inverted frustum, a belt conveyor 2 for supplying the raw material to the rotary hopper A, an impeller B in the form of a hollow disc rotatably supported between the rotary hopper A and the blast furnace 1, an inclined stationary chute C disposed to oppose the discharge port of the impeller, and an electric motor 3 mounted above the rotary hopper A for driving the impeller B. Although the rotary hopper A is driven by a driving device D at a relatively low speed of about 20 r.p.m., the impeller B coupled directly to the shaft 4 of the motor 3 is rotated at a high speed of about 1500 r.p.m. The material supplied to the center of the impeller B from the conveyor 2 via the low speed rotary hopper A is caused to rise along the conical base member of the impeller B (see FIG. 3) by the centrifugal force created by the high speed rotation of the impeller B shown by an arrow R, the locus of the spiral motion of the raw material being shown by dotted lines 20. Then the raw material is discharged through the discharge ports 21 of the impeller into the annular chamber 30 of the inclined chute C and then falls down under the gravity along the inclined chute into the blast furnace 1. The discharge ports 21 are defined between a plurality of blades equally spaced around the periphery of the impeller. Each blade is in the form of a wedge tapered in the direction of rotation R of the impeller. For this reason, as the impeller B rotates at a high speed, a rare air region or a negative pressure region is formed to the rear of each blade 22 between the atmospheric pressure and the furnace top gas pressure as shown in FIG. 4. Such negative pressure regions are effective to prevent leakage of the furnace top gas to the outside which causes wear and burn out of the portions coming into contact with the hot gas. The ability of the negative pressure regions for interrupting the leakage of hot gas depends upon the number of revolutions of the impeller B. For this reason, in order to efficiently prevent the leakage of the gas, it is necessary to vary the gas interrupting ability in accordance with the variation in the pressure in the furnace near the discharge ports 21.

Figure 1:
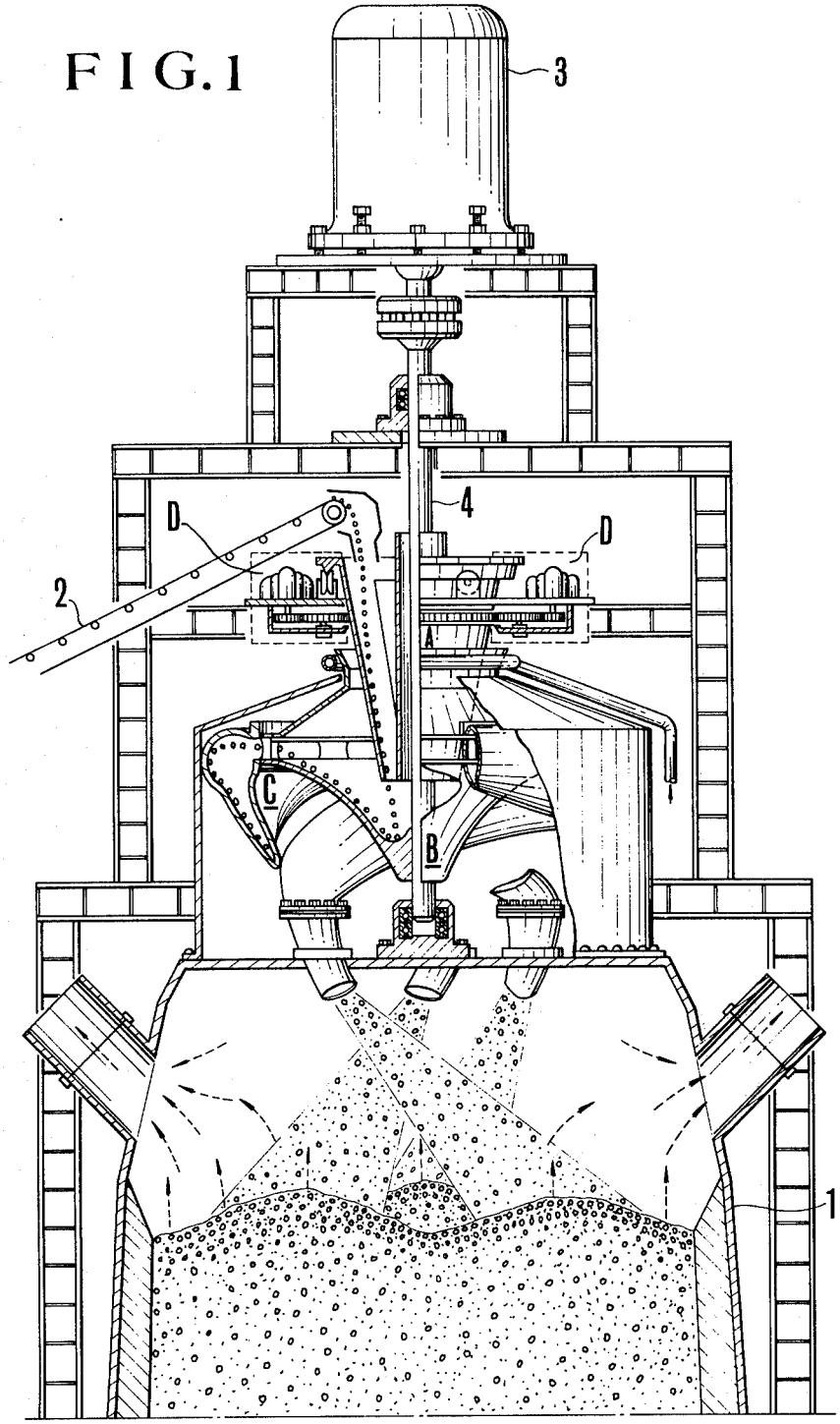
FIG. 1 is a transverse sectional view showing a blast furnace and a raw material charging apparatus to which the invention is applicable.
Figure 2:
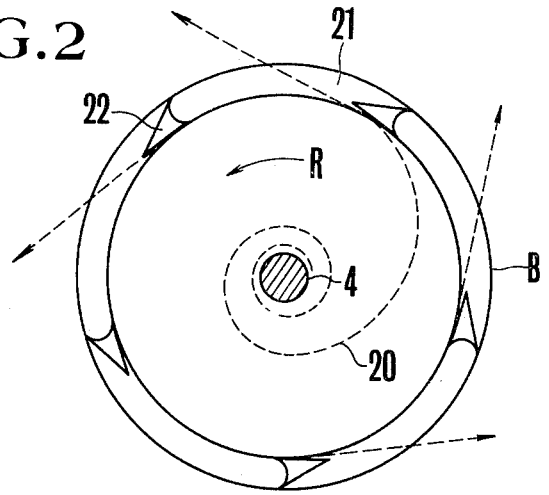
FIG. 2 is a diagram useful to explain the operation of the impeller utilized for the blast furnace shown in FIG. 1.
Figure 5:
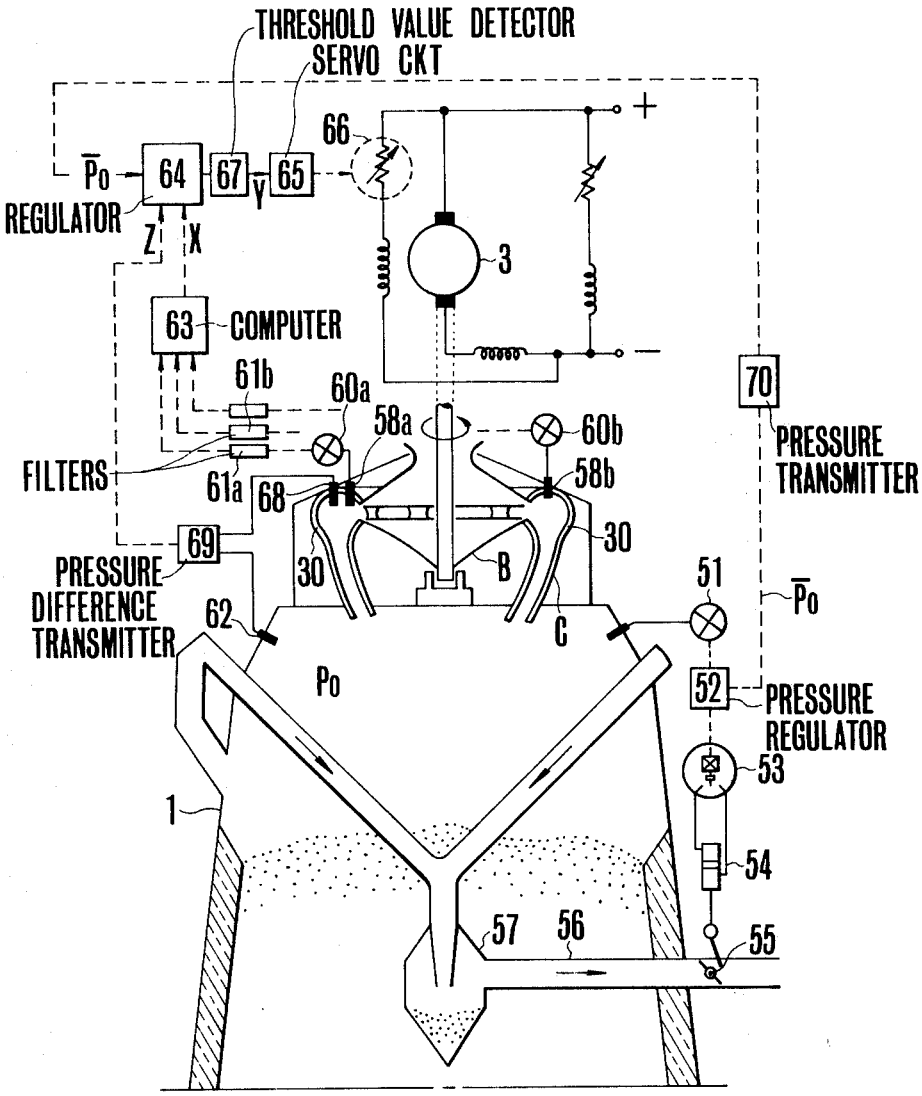
FIG. 5 is a diagrammatic representation showing one embodiment of this invention.

FIG. 5 illustrates one embodiment of this invention in which elements identical to those shown in FIG. 1 are designated by the same reference numerals. A main furnace top gas pressure control system including a pressure detector 51, a pressure regulator 52, an electro-oil pressure converter 53, an operation cylinder 54, a regulating valve 55 (castan valve), a gas exhaust conduit or pipe 56 and a dust separator 57 is the same as the conventional type. In addition to this main control system for controlling the quantity of the exhaust gas, according to this invention, there are provided a plurality of (at least five) pressure sensors 58*a*, 58*b* . . . , located at equally spaced points on the annular chamber 30, pressure transmitters 60*a*, 60*b* . . . , filters 61*a*, 61*b* . . . for eliminating small variations in the detected pressure, and a detector 62 for detecting the furnace top pressure Po. There is also provided a control system including a computer 63 calculating the mean value of the electrical signals generated by the pressure transmitters 60*a*, 60*b* . . . and representing the detected pressures, a regulator 64, a servo-circuit 65, and a speed controller 66 for the driving motor 3. Thus, the computer 63 is supplied with signals representing the pressures in various portions of the annular chamber 30 for calculating the mean value of the detected pressures to supply its output to the regulator 64. The regulator 64 compares the output X from the computer with an electric signal representing the predetermined furnace top gas pressure $\bar{P}o$-and produced by a pressure transmitter 70 connected to the pressure regulator 52 to produce a signal Y applied to the servo-circuit 65. The speed controller 66 responsive to the servo-circuit 65 determines the speed of the motor. With this control system it is possible to make zero the amount of gas leaking to the outside through the impeller B irrespective of the set value of the furnace top gas pressure. When the variation in the furnace top gas pressure about the preset value $\bar{P}o$ exceeds a preset level, a threshold value detector 67 renders inoperative the servo-circuit 65 for the purpose of preventing otherwise occuring troubles caused by a through-blow phenomenon whereby the gas under an excessive pressure is discharged to the atmosphere through the exhaust pipe 56 under the control of the main control device described above and through the impeller. Accordingly, it is possible to maintain the furnace top pressure at or near the preset value.

With the control systems described above, since the pressure detectors 58*a,* 58*b,* mounted on the annular chamber 30 are located remote from the furnace top, an accurate control of the furnace top gas pressure can not be accomplished while making zero the quantity of the gas discharged from the negative pressure regions unless a certain delay in the control of the furnace top gas pressure Po when it varies is taken into consideration. For the purpose of compensating for such delay in the control, a signal to be described later is applied to the regulator 64 of the control system described above thus causing the speed of the impeller to respond to the furnace top gas pressure $\bar{P}o$ which varies in a certain range. This measure using an additional control system is effective to more accurately prevent the leakage of the gas. Thus, information produced by a pressure sensor 62 mounted on the furnace top and by a pressure sensor 68 mounted on the annular chamber 30 are applied to a pressure difference transmitter 69 which applies a signal Z corresponding to the differential information to the regulator 64. Signal Z modifies the preset pressure signal Po so that the signal Y produced by the regulator 64 is proportional to the difference between the modified preset pressure signal and the signal X representing the mean value of the pressure in the annular chamber 30. Signal Y is applied to servo-circuit 65 for controlling the speed of the driving motor 3 and the impeller 3 in accordance with the variation in the pressure. This additional control system increases the speed of the impeller prior to the increase in the pressure in the annular chamber 30 thereby preventing leakage of gas caused by the control delay.

The pressure sensor and the pressure transmitter may be of the well known type such as an electromagnetic type or an electrostatic type. Further, the filter, the computer, the regulator and the servo-circuit may also be of the well known type so that it is believed it unnecessary to describe them in detail.

As can be readily understood from the foregoing description, according to the method and apparatus of this invention, it not necessary to change the speed of the impeller each time the set furnace pressure is changed when the operation condition of the blast furnace is changed. Moreover, for blast furnace of the different capacity, it is not necessary to use impellers having different diameter or to vary the spacing between the blades of the impeller. Further, according to this invention it is not only possible to readily reduce to zero the amount of gas leaking from the negative pressure regions of the impeller in response to the variation in the furnace top gas pressure within a certain range but also possible to automatically discharge abnormal rise in the gas pressure thus decreasing he width of the variation in the gas pressure. For this reason, it is possible to more accurately control the furnace top gas pressure than any prior art method thereby increasing the useful life of the raw material charging apparatus by preventing damage thereof.

I claim:

1. In a blast furnace installation comprising a blast furnace and a raw material charging apparatus including a hollow inverted frustum shaped rotary hopper mounted above said blast furnace, conveyor means for supplying the raw material to said rotary hopper, a hollow disc shaped impeller located beneath said rotary hopper for receiving the raw material therefrom, stationary inclined chute means including an annular chamber member surrounding the periphery of said impeller for receiving the raw material discharged therefrom, and an electric motor mounted above said rotary hopper for driving said impeller, a method of controlling the gas pressure in the top of said blast furnace comprising the steps of detecting the gas pressure in said annular chamber member of said inclined chute means at a plurality of circumpherencially spaced points, comparing the mean value of said detected gas pressures with a preset furnace top gas pressure for producing a control signal proportional to the difference therebetween, and controlling the speed of said motor by said control signal thereby reducing substantially to zero the amount of the gas discharged to the atmosphere from said impeller.

2. The method according to claim 1 which further comprises the step of varying said predetermined furnace top gas pressure by the difference between the pressure in said annular chamber member and the actual furnace top gas pressure.

3. In a blast furnace installation comprising a blast furnace and a raw material charging apparatus including a hollow inverted frustum shaped rotary hopper mounted above said blast furnace, conveyor means for supplying the raw material to said rotary hopper, a hollow disc shaped impeller located beneath said rotary hopper for receiving the raw material therefrom, stationary inclined chute means including an annular chamber member surrounding the periphery of said impeller for receiving the raw material discharged therefrom, and an electric motor mounted above said rotary hopper for driving said impeller, apparatus for controlling the gas pressure in the top of said blast furnace comprising a main control system detecting the furnace top gas pressure to control, in accordance with a predetermined furnace top gas pressure, the amount of gas discharged through a gas exhaust conduit, a plurality of pressure detectors provided for said annular chamber member at equally spaced points around the periphery of said annular chamber member, a plurality of electric signal generators responsive to the outputs of said pressure detectors, respectively, a computer for producing the mean value of the electric signals produced by said electric signal generators, a regulator for producing an output proportional to the difference between said mean value and the predetermined furnace top gas pressure, and servo-means responsive to the output from said regulator for controlling the speed of said motor thereby reducing substantially to zero the amount of the gas discharged to the atmosphere from said impeller.

4. The apparatus according to claim 3 which further comprises a threshold value detector connected between said regulator and said servo-means for disenabling said servo-means when the variation of said furnace top gas pressure exceeds a predetermined level.

5. The apparatus according to claim 3 which further comprises a pressure differential transmitter for generating an electric signal supplied to said regulator in response to the difference between the pressure in said blast furnace and the pressure in said annular chamber member of said inclined chute means.

* * * * *